US006786003B2

(12) United States Patent
Gilbert

(10) Patent No.: US 6,786,003 B2
(45) Date of Patent: Sep. 7, 2004

(54) MULTI-LAYER SLEEVE

(76) Inventor: Scott R. Gilbert, 325 Lake Pointe Dr., Akron, OH (US) 44333-1794

( * ) Notice: Subject to any disclaimer, the term of this patent is extended or adjusted under 35 U.S.C. 154(b) by 0 days.

(21) Appl. No.: 10/189,658

(22) Filed: Jul. 3, 2002

(65) Prior Publication Data

US 2004/0003537 A1 Jan. 8, 2004

(51) Int. Cl.[7] ..... A01G 9/02; A47G 7/08
(52) U.S. Cl. ..... 47/72; 47/41.01
(58) Field of Search ..... 47/72, 41.01

(56) References Cited

U.S. PATENT DOCUMENTS

| | | | | | |
|---|---|---|---|---|---|
| 3,376,666 | A | * | 4/1968 | Leonard | 47/41.01 |
| 5,493,809 | A | * | 2/1996 | Weder et al. | 47/72 |
| 5,647,168 | A | * | 7/1997 | Gilbert | 47/72 |
| 5,937,576 | A | * | 8/1999 | Weder et al. | 47/72 |
| 5,974,730 | A | * | 11/1999 | Chien | 47/41.01 |
| 6,115,962 | A | * | 9/2000 | Weder et al. | 47/72 |
| 6,129,208 | A | * | 10/2000 | Ferguson | 206/423 |
| 6,298,601 | B1 | * | 10/2001 | Weder et al. | 47/72 |
| 6,345,467 | B1 | * | 2/2002 | Weder | 47/72 |

FOREIGN PATENT DOCUMENTS

| | | | | |
|---|---|---|---|---|
| DE | 2830873 | A1 * | 2/1979 | A01K/1/01 |
| JP | 55132773 | A * | 10/1980 | C08J/7/04 |

* cited by examiner

*Primary Examiner*—Son T Nguyen
(74) *Attorney, Agent, or Firm*—Renner, Otto, Boisselle & Sklar

(57) ABSTRACT

Various sleeves and bags or packaging goods, especially floral groupings such as bouquets and pot plants, can be provided using the present invention. Exemplary sleeves are manufactured with an outer wall and an inner wall, each of which is formed of two layers. The outer layers are a transparent or semitransparent sheet material such as polypropylene, and the inner layers are a nonwoven fabric material made of a compatible polymer. The outer and inner layers of each wall may be printed with complementary images or patterns. The inner and outer layers of the one or both walls may be fastened to each other not only along the side edges of the sleeve, but also at discrete locations along the top edge where the sleeve is opened. The connection can be made using glue or the equivalent, by melting or welding the two layers together, or by punching a tab of the outer layer through the inner layer. The top and bottom edges of the inner and outer layers may be coincident, or not. The top and bottom edges of the inner and outer layers may form a single straight line, plural connected straight lines (zigzags), or curved lines. The bottom edge of the sleeve may be sealed or opened, and it may include a gusset. The fabric inner layers may include chemical treatment to preserve or protect the product contained within the sleeve.

58 Claims, 5 Drawing Sheets

MULTI-LAYER SLEEVE

FIELD OF THE INVENTION

The present invention may be applied to floral sleeves and in particular to sleeves used in the retail sale of pot plants, bouquets, and the like. Aspects of the present invention may also be applied to the manufacture of other packaging, and in general to products made with non-woven fabric.

BACKGROUND OF THE INVENTION

Sleeves are used in the retail sale of pot plants and bouquets. The sleeves serve to protect the leaves, blooms, and stems of a bouquet from breaking or being damaged, during shipping from the grower to a retail outlet, while on display, and while being carried home by a customer.

Sleeves have been decorated with printed images to enhance the appearance of the pot plant or bouquet. Some sleeves are opaque, made of solid, single-color material, or made with various printed images that cover some or all of an opaque substrate. Alternatively, the substrate may be at least partly transparent. In the case of pot plants, the portion of the sleeve that surrounds the pot and lower branches may be printed with images to cover these areas while the balance of the sleeve is transparent leaving the foliage and flowers exposed to promote retail sale. In the case of bouquets, the stems may be at least partially hidden by images on the sleeve while the blooms and adjacent foliage are at least partially visible through the surrounding sleeve. The printed images may be seasonal, for example, red hearts on Valentine's Day, or red and green for the Christmas holidays, or merely decorative. The number and variety of printed images for both bouquet sleeves and pot plants sleeves is limited only by the imagination.

Sleeves especially for pot plants have also been made with separable upper portions. Typically the sleeve has a line of perforations that falls at or above the top of the pot. The retail customer may then tear off the part of the sleeve surrounding the pot plant's foliage and leave the remainder of the sleeve to decorate the pot and perhaps hide some part of the stems. Sleeves generally of this sort have been marketed by Professional Package Company of Cleveland, Ohio, the assignee of the present invention.

Heretofore most sleeves have been manufactured of a single material. Specifically, while different manufacturers have used different materials, each sleeve has generally been formed from two layers of the same material. Although some may have suggested that sleeves might be made of laminated materials, sleeves have not heretofore been commercialized that are made with layers of different materials joined at the seams so as to appear as independent layers.

SUMMARY OF THE INVENTION

The present invention provides a multi-layer sleeve with a function and an attractive appearance heretofore unknown in the art, as well as a method for making such a sleeve. The present invention may be used to form a sleeve with front and back walls that open to reveal a central opening to receive a pot plant, floral bouquet, or other items to be packaged. At least one of the front and back walls is made with two or more non-laminated layers. The outermost layer of the multi-layer wall may be at least partially transparent or translucent, and the innermost layer may be opaque. Images on the inner and outer layers of the multi-layer wall may cooperate to provide a pleasing visual effect.

In addition or alternatively, the inner and out layers may be made of materials having different physical properties. For example, the inner layers or layers may be fluid absorbing, while the outer layers are impermeable. This arrangement may be useful where the item to be placed in the sleeve requires moisture, such as seedlings or vegetables, or requires a preservative such as a light oil or an anti-oxidant to protect against rust.

All the layers of the sleeve are made from thermoplastic materials that are fed from rolls into a machine that uses hot dies to cut through the layers and weld the sleeve edges together. The materials of the sleeve layers are selected with physical properties that allow them to be cut and sealed in a single operation. Various methods are used to allow the layers of the sleeve to be readily opened to reveal the central opening. For example, the layers on each side of the central opening may be attached to each other by an adhesive or by a mechanical interconnection. Alternatively the layers on the front and back may be contoured in a way that allows easy manual separation.

The sleeves of the present invention may be manufactured on a machine with an inlet end tension section to provide the webs at uniform tension, a synchronization section where the shaping, cutting or gluing operations may be performed along the top and bottom edges of selected layers, and a cutting and trimming section where all layers are cut and the side seams welded to form a sleeve.

BRIEF DESCRIPTION OF THE DRAWINGS

These and other features of the present invention will become clear from the following description of preferred embodiments when taken together with the accompanying drawings. In the drawings hidden lines are shown in a conventional manner, while lines of perforations are shown with alternating long and short dashes.

DESCRIPTION OF PREFERRED EMBODIMENTS

Figure 1:
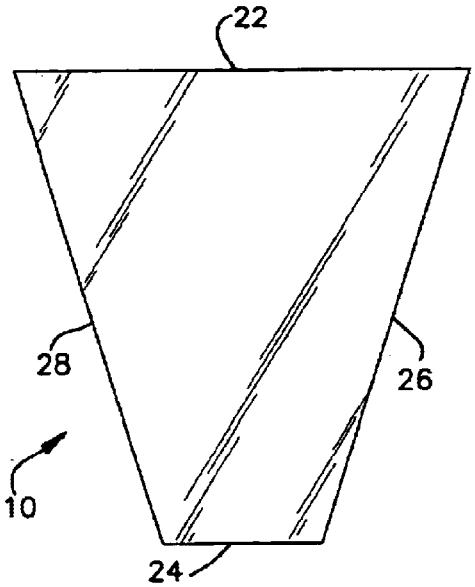
FIG. 1 is a front elevation view of a sleeve using the present invention in a flat, as-manufactured condition.

The sleeve 10 illustrated in FIG. 1 is constructed using the present invention. The sleeve 10 is for packaging and the retail sale of floral groupings which may include, for example, cut fresh flowers 12 (FIG. 2), dried flowers, artificial flowers and plants, live pot plants, and other similar horticultural products and combinations of them. However, the present invention is not limited in its use, and it may be used to form packages for other items such as brooms or feather dusters. It may also be used to make packages for produce, such as vegetables or fruit. Packages made using the present invention may also be used to ship seedlings or other plant material. Packages made following the present invention may also be used to package a variety of other products.

The sleeve 10 (FIG. 3) is made of two inner layers 14, 16, and two outer layers 18, 20. Any one of the layers may be omitted, while still taking advantage of at least some of the features and advantages of the present invention. If the inner layers 14, 16 are made of a soft, non-abrasive material, delicate or scratchable items can be packaged safely. If the inner layer(s) 14, 16 is made of an absorbent material, then the inner layer(s) may be treated with a light oil or other preservative to protect against rust or other degradation. For example, for fresh produce the inner layers may be treated with an anti-oxidant to preserve freshness.

The sleeve 10 may be decorated with various images to present a pleasing appearance and so promote sale of the floral groupings or other goods. The sleeve 10 may also include printed care instructions or other textual material. As discussed below the multi-layer nature of the sleeve 10 presents many pleasing graphic design opportunities.

The sleeve 10 is manufactured flat and may be stored flat. In FIG. 1 the sleeve 10 is shown in its flat, as manufactured state. The sleeve 10 is trapezoidal with a top edge 22 and bottom edge 24 that are parallel to each other. The sleeve 10 has oppositely tapered side edges 26, 28. The sleeve 10 is made from four layers 14, 16, 18 and 20 (FIG. 3) of sheet material that are sealed along the side edges 26, 28. As shown in FIG. 1 the top and bottom edges 22, 24 are unsealed. In other sleeves using the present invention the sleeve bottom edge 24 is closed by sealing across the bottom. Alternatively, the bottom may be closed by means of a gusset 30 (FIG. 12) as is well known in the art, or by using a single web folded in half to make a closed bottom.

The front inner and outer layers 14, 18 (FIG. 3) form the front wall 40 of the sleeve 10, and the rear inner and outer layers 16, 20 form the rear wall 42. The sleeve 10 (FIG. 2) may be opened by separating the front and back walls 40, 42 to reveal a central opening 44 to receive a floral grouping 46. When opened, the sleeve 10 assumes a more or less conical shape. The various layers 14–20 are not laminated to each other, that is, they are not connected to each other except along the side edges 26, 28 and in some sleeves along the bottom edge 24 and top edge 22. As a result, the inner layers 14, 16 and outer layers 18, 20 may appear to be separate independent wrappings.

Figure 3:
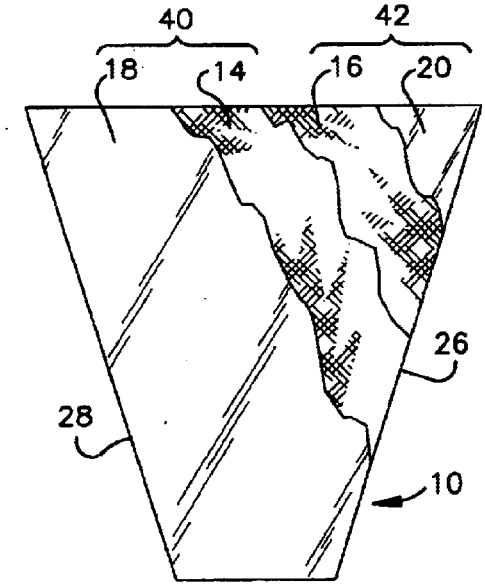
FIG. 3 is a partly cut away view of the sleeve of FIG. 1 showing two outer layers and two inner layers.

At least one wall 40, 42 of the sleeve 10 is formed of two layers (or substrates) of sheet material. As illustrated in FIG. 3, the sleeve 10 is formed of four layers: front and back outer layers 18, 20 and front and back inner layers 14, 16. The outer layers 18, 20 are formed of a transparent or translucent material and the inner layers 14, 16 are formed of a material that may or may not be opaque. The outer layers 18, 20 and the inner layers 14, 16 may be printed with patterns or images selected to promote sale of the floral groupings or other items within the sleeve. The outer layers 18, 20, being at least translucent, may be printed with a first image or pattern, and the image on the inner layers 14, 16 may be a complementary image or pattern.

The sleeve 10 shown in FIG. 3 is made with four layers 14–20, but more or fewer layers could be used. For example, the back wall 42 could consist of a single layer (that may or may not be opaque) while the front wall 40 could consist of a transparent or translucent outer layer 18 and inner layer 14 that may or may not be opaque. Or, the front wall 40 or back wall 42 could consist of three or more layers. All these may achieve a desirable visual effect by having layered, complementary images, or by having no images at all.

The inner layers 14, 16 may have images on a substrate that is opaque or partially transparent or translucent. By way of example only, the inner layers 14, 16 could have images of a town covered in snow while the outer layers 18, 20 have snowflakes and/or a moon and stars. In another example, the inner layers 14, 16 could be printed with diffuse flower images while the outer layers 18, 20 could have discrete, sharply defined images of flowers. The variety of complementary images is endless. They share in common that at least some of the inner layers 14, 16 is visible through the outer layers 18, 20. If the outer layers 18, 20 are formed of an essentially transparent sheet material or substrate on which an image is printed, then the inner layers 14, 16 will be clearly visible through the non-image areas of the outer layers. If the outer layers 18, 20 have images on a translucent substrate then a less clear image of the inner layer(s) 14, 16 will be seen from the outside.

The sleeve 10 may be made by heat sealing the edges 26, 28. In this process webs of thermoplastic sheet material that form the inner and outer layers 14–20 are fed intermittently through a machine (described more fully below) where heated blades press against the webs to cut and seal the webs in the shape of a sleeve.

By way of background, the ability to seal, cut and trim thermoplastic sheet material depends on the characteristics of the materials including not only its chemistry, but also other physical properties. When the sheets are, for example, cast polypropylene which is relatively dense and has a relatively high mass to surface area ratio, heat sealing is relatively straightforward. Heat sealing is substantially more difficult when the sheet material is a fabric, either woven or non-woven which has a much lower mass to surface area ratio and is less dense. In the former situation a blade or rule die is heated to a temperature that allows it to cut through the substrate, forming a margin next to the blade of softened or nearly molten sheet material that then cools and sets, welding the layers together at their edges.

Figure 2:
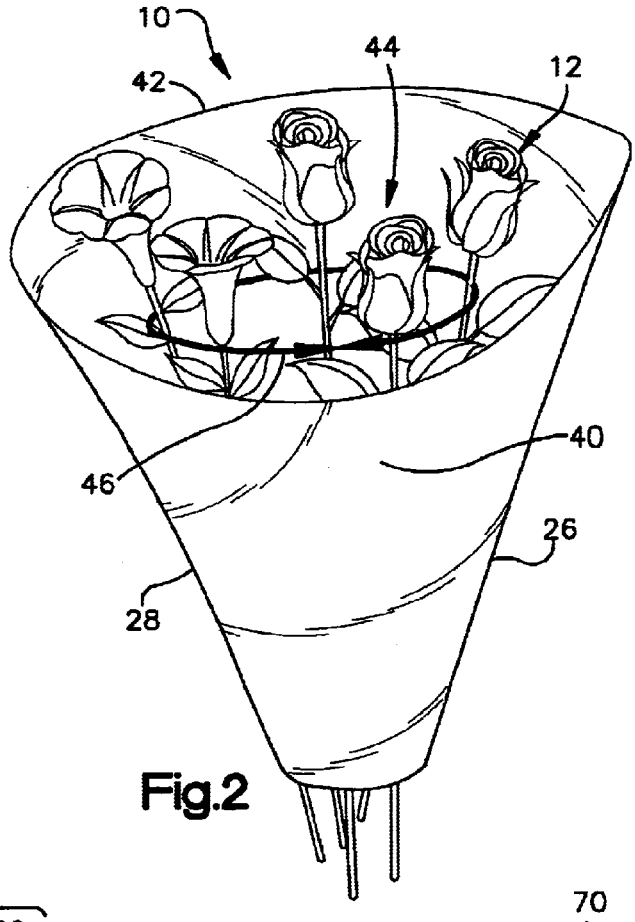
FIG. 2 is a perspective illustration of the sleeve of FIG. 1 in an open condition and with a bouquet in its central opening.

In the sleeve 10 shown in FIGS. 1–3, the outer layers 18, 20 are formed from a substrate of cast polypropylene while the inner layers 14, 16 are formed from a substrate of a non-woven fabric that is also polypropylene. These two materials have very different feels, one being dense, the other being soft, almost fuzzy. However, both materials have some similar physical properties. The two materials have approximately the same melt temperature and approximately the same melt index. The melt index is a measure of the viscosity of the material at an elevated temperature. The melt indices of the materials of the various layers are close enough that one material does not become excessively inviscid before the other has softened enough to flow. The details of the heat sealing operation are discussed in more detail below. The materials for the substrates 18–20 may be any polyolefin including polybutylene, polypropylene, polyethylene, and/or polystyrene, and the substrates may be the same material or different materials so long as the performance requirements are met.

Figure 4:
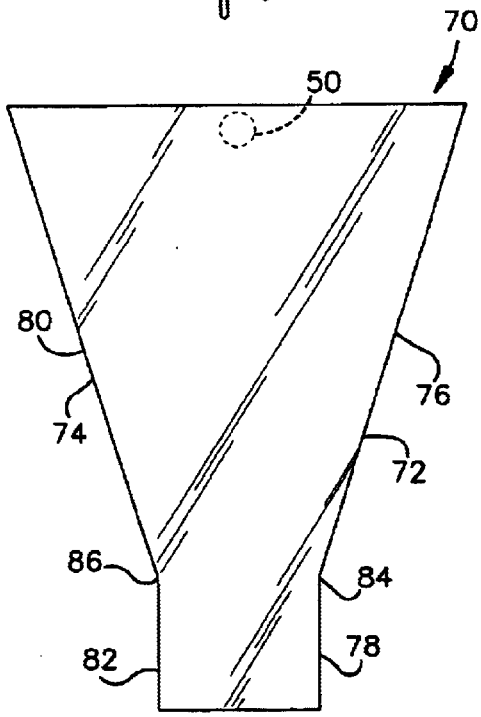
FIG. 4 is a front elevation view of a sleeve using the present invention with a Y-shape and having an adhesive connecting layers of the front wall to each other and the layers of back wall to each other.

The sleeve 10 (FIGS. 1–3) includes features to facilitate being opened to reveal the space 44 within. In opening the sleeve 10 it is necessary to separate two inner layers 14, 16 from each other so that the floral grouping 46 may be properly placed in the sleeve. This is facilitated by connecting each outer layer 18, 20 to its respective inner layer 14, 16 at at least one discrete location between the side seams 26, 28 of the sleeve 10. This can be done in a number of different ways. For example, the inner layer 14 and outer layer 18 that form the front wall 40 can be glued to each other as shown at 50 (FIG. 4). Any suitable mucilage, glue, or adhesive may be used, and only a small amount located near the midpoint of the top edge may be required. See FIG. 4. This spot of glue 50 should be small enough that it is not visually conspicuous or offensive to a prospective customer through the outer layer, but should be large enough to assure that when a worker or retail customer grips the outer layer 18, the inner layer 14 will necessarily follow a separating movement. Typically a spot of glue 50 less than one inch in diameter will suffice. Different materials may require different types of glue and more spots of the same or different sizes. For example there could be a row of discrete glue spots between the inner layers 14, 16 and the outer layers 18, 20, or even a continuous stripe of glue. In addition, a similar spot of or spots of glue 50 may be used between the back layers 16, 20.

As an alternative to an adhesive, various mechanical means can be used to secure the front layers 14, 18 to each other and/or the back layers 16, 20 to each other. For example, a hot pin 51 (FIG. 21) may be pressed through the layers 14–20 to be joined. This produces a bond much like a spot weld in which the layers 14–20 to be joined are melted together. Alternatively a punch may be used to cut and press a small finger or tab 52 (FIGS. 18, 19) of one of the layers (e.g., 18) through and into engagement with the adjacent layer (e.g., 14). The tab 52 may have a barbed shape (FIG. 18) to help hold the layers 14, 18 together. Alternatively, the tab 52 may be a triangle 54 (FIG. 20) punched from the outer layer 18 that penetrates a similarly shaped opening in the inner layer 14. Any shape will do as long as the front layers 14, 18 or the back layers 16, 20 (respectively) stay together at least well enough to allow a worker or retail customer easily to open the sleeve 10, separating the two walls 40, 42 from each other and revealing the inner space 44. As with the glue spots 50, one of ordinary skill in the art will be able to select the proper number of barbs or welds and their best location to effect the desired ease of separating the layers 14, 18 of the front wall 40 from the layers 16, 20 of the back wall 42.

Another method of fastening the layers 14, 18 and/or 16, 20 together is to apply localized intense radiant energy. For example, the desired layers may be connected to each other using ultrasonic energy or coherent electromagnetic energy. In either case, local heating and melting occurs, resulting in a bond between the heated layers. The location of the bonds formed in this manner between the layers 14, 18 and/or 16, 20 can be selected to achieve the purpose of facilitating opening of the sleeve 10.

Figure 5:
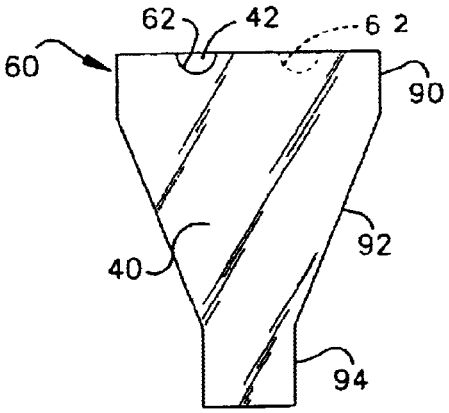
FIG. 5 is a front elevation view of a sleeve using the present invention having contoured top edges to facilitate opening of the sleeve.

In another approach, thumb openings 60 (FIG. 5) may be formed in the front wall 40 and/or the back wall 42, or both. FIG. 5 shows a sleeve 60 with thumb cutouts 62 through the layers 14, 18 of the front wall 40 (to the left of the vertical centerline) and through both the back layers 16, 20 of the back wall 42 (to the right of the vertical centerline). If thumb openings 62 are formed in both the front 40 and back wall 42, they are positioned so as not to be in alignment with each other. The thumb opening 62 in the front wall 40 makes it possible to grip the back wall 42 and vice versa, thereby facilitating separating the layers 14–20 and opening the sleeve 40.

Figure 6:
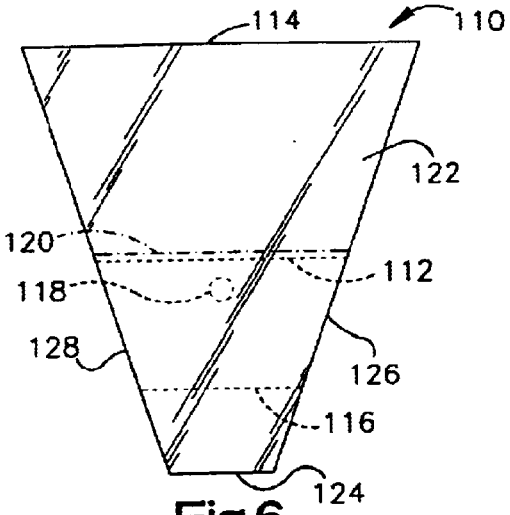
FIG. 6 is a front elevation view of a sleeve using the present invention having inner layers shorter than the height of the outer layers and a tear line across the outer layers near the top of the inner layers.

In some situations the top of the inner layers 14, 16 may not be even with the top of the outer layers 18, 20. In that case it may be necessary to adhere a part of the top edge of the inner layers 14, 16 to the adjacent outer layers 18, 20 so that when the outer layers are opened, the inner layers follow suit to reveal an inner retaining space between the two inner layers. This is illustrated in FIG. 6 where spots of glue 118 are shown holding each inner layer to its respective outer layer. In either situation the top edge of both layers 14, 18 of the front wall 40 may be shorter than or below the top edge of the back wall 42, as discussed below in connection with FIG. 15. In those cases, no connection between the layers 14, 18 forming the front wall 40 may be required to ease opening the sleeve 10.

Figure 15:
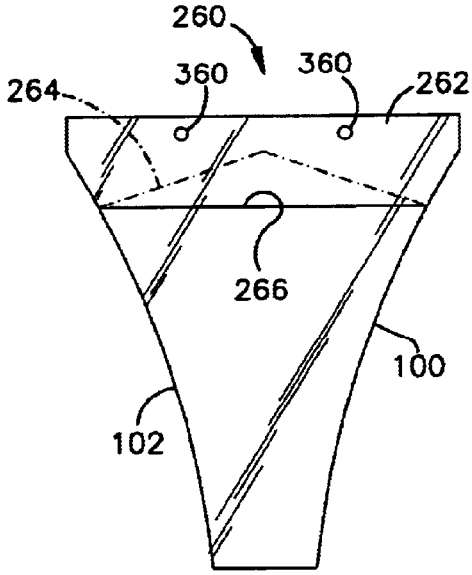
FIG. 15 is a front elevation view of a sleeve using the present invention having a header and horizontal tear line for separating the sleeve from the header and showing a sleeve with curved side edges.

The sleeve 10 made with multiple layers may be made in a number of different configurations. For example, FIG. 4 shows a Y-shaped sleeve 70. The side edges 72, 74 of the sleeve shown in FIG. 4 are each formed from a pair of straight-line segments 76, 78, 80, 82 that meet at vertices 84, 86, respectively. The side edges 72, 74 could each be formed of three or more line segments, for example, 90, 92 and 94 as shown in FIG. 5. Moreover, the line segments 90, 92 and 94 need not be straight. Some or all of the edges 100, 102 may be curved as illustrated in FIG. 15.

FIG. 6 illustrates another sleeve 110 made using the present invention. In this sleeve the webs from which the inner layers 14, 16 are made are narrower than the webs of the outer sleeve. The result is that the inner layers 14, 16 have a top edge 112 that is lower than the top edge 114 of the outer layers 18, 20. The taper of the side edges 126, 128 as well as the placement of the top edges 112 of the inner layers may be selected for use in packaging a pot plant. In the sleeve 110 the inner layers 14, 16 substantially surround the pot around which the sleeve 110 may be used and perhaps the lower portion of the plant stems. The lower edge 116 of the inner layer(s) 14, 16 is positioned so that when a pot plant is in the sleeve 110, the lower edge 116 of the inner layer(s) 14, 16 is approximately flush with the bottom edge of the pot plant. In this case, the lower part of the sleeve 110 consists of the outer layers 18, 20 only where they extend beyond the bottom of the bottom of the pot; these may be folded under the pot more conveniently than if multiple layers are to be folded under the pot.

The sleeve 110 shown in FIG. 6 may also have a line of perforations 120 forming a tear line for separating an upper portion of the sleeve from a lower portion. The sequence of individual perforations define a tear line 120 that is straight and even with or just above the top edges 112 of the inner layers 14, 16. In use, a worker or retail customer may tear off the upper portion 122 once a pot plant is ready to be displayed, leaving an attractive, multi-layer sleeve 110 around the pot.

The bottom edge 124 of the sleeve 110 shown in FIG. 6 may be open or closed as shown. A watertight or water resistant seam on the edges 126, 128 and bottom 124 may be helpful in transporting a pot plant and its display by the consumer.

Figure 7:
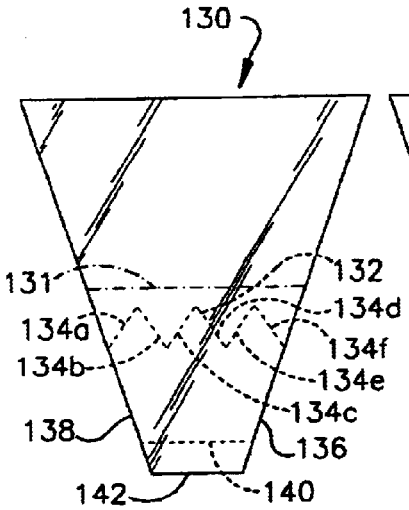
FIG. 7 is a front elevation view of a sleeve using the present invention showing an outer layer with a horizontal tear line and inner layers with a patterned top edge below the outer layer's tear line.

FIG. 7 shows yet another sleeve 130 made using the present invention. The outer layers 18, 20 include a sequence of perforations that define a single, straight tear line 131 above the top of the inside layer. This sleeve 130 is similar to FIG. 6 except that the upper edge 132 of the inner sleeve is not formed in a single, straight line but rather a number of straight line segments 134*a–f* connected with each other in series. Thus the top edge 132 of the inner layers 14, 16 of the sleeve 130 in FIG. 7 is a zigzag shape. Any of a variety of edges could be used instead of the zigzag 132; for example, the top edge 132 of the inner sleeve could be curved with a regular or irregular pattern of curves, or with a single continuous curve with none, one, or more inflection points or crests and valleys. For example, the top edge 132 could be curved to be higher in the middle than at the seams 136, 138 so that when opened to receive a round pot, the sleeve top edge 132 approximately lies in a plane parallel to the plane of the top of the pot, or various decorative effects could be achieved. FIG. 7 also shows the bottom edge 140 of the inner layers 14, 16 closer to the bottom 142 of the sleeve 130 than in FIG. 6, but this is a matter of design choice.

Figure 8:
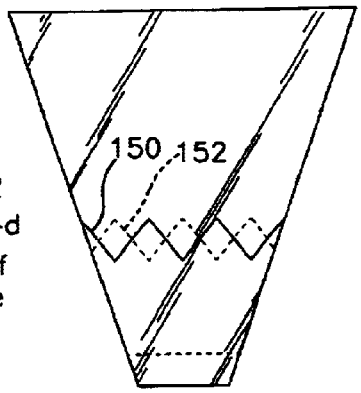
FIG. 8 is a front elevation view of a sleeve using the present invention having an outer layer with a patterned tear line and an inner layer with a patterned top edge.
Figure 9:
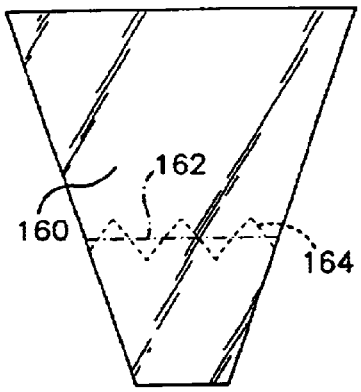
FIG. 9 is a front elevation view of a sleeve using the present invention showing an outer layer with a horizontal tear line and an inner layer with a patterned edge partially above the tear line.

FIG. 8 shows another arrangement in which the top edges 150, 152 of the inner and outer walls, respectively have complementary shapes formed from a sequence of straight lines forming zigzags. The inner layers 14, 16 are precut, while the zigzag pattern in the outer layers is formed by perforations. In the sleeve shown in FIG. 9, the outer wall 160 has perforations 162 extending straight across while the inner layer has a precut zigzag pattern 164 that extends above and below the line of perforations 162 in the outer wall 160.

Figure 10:
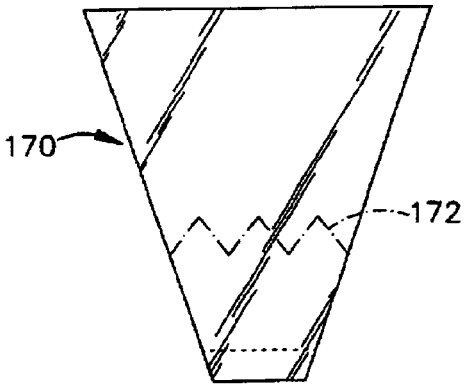
FIG. 10 is a front elevation view of a sleeve using the present invention showing inner and outer layers with a patterned tear line and an inner layer stopping short of the bottom of the sleeve.

In the sleeve 170 illustrated in FIG. 10, the inner layers 14, 16 and outer layers 18, 20 all have the same series of straight line segments forming a zigzag line 172. The inner layers 14, 16 are precut and terminate at the line 172. The outer layers have a line of perforations coincident with the inner layers' top edges.

Figure 11:
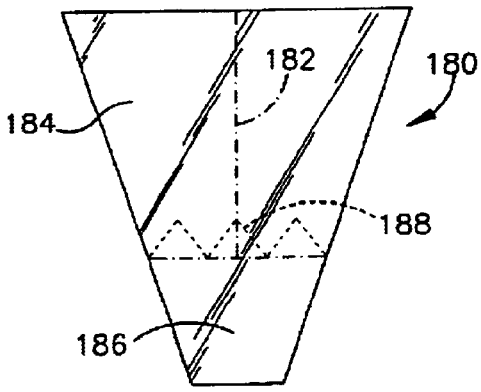
FIG. 11 is yet another arrangement of tear lines for the outer layers and a patterned edge for the inner layers.

FIG. 11 illustrates another sleeve 180 made using the present invention. In this sleeve the outer layers 18, 20 have an inverted T-shaped tear line 182. This tear line 182 leads down from the top edge to a horizontal tear line that separates the upper portion 184 of the outer layer 18, 20 from the lower portion 186. The junction between the horizontal and vertical tear lines has been shown as perpendicular, but it could be a curve. Such a curve would smooth the changing direction of the tear. As shown in FIG. 11, the top edge 188 of the inner layer 14, 16 is formed by a series of linear segments that form a zigzag.

Figure 12:
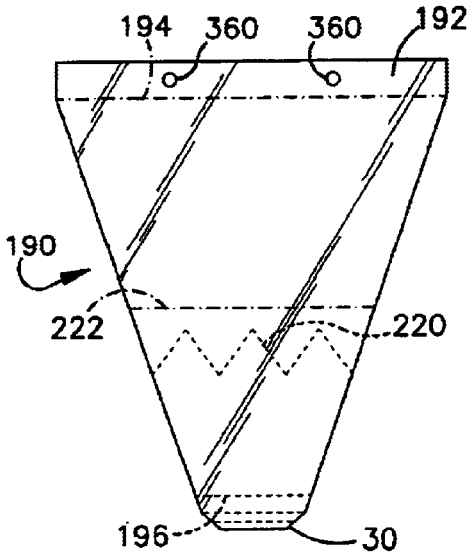
FIG. 12 is a sleeve using the present invention, having a header and a tear line to separate the sleeve from the header and also having a gusset in the bottom of the sleeve.

FIG. 12 illustrates yet another sleeve 190 made following the teachings of the present invention. Here the outer layer 20 of the back wall 42 has a header 192 used for bundling the sleeves 190 and/or mounting them on a dispenser. The header 192 is separated from the balance of the sleeve 190 by a tear line 194. Any sleeve 190 made using the present invention may be made with such a header 192.

Figure 22:
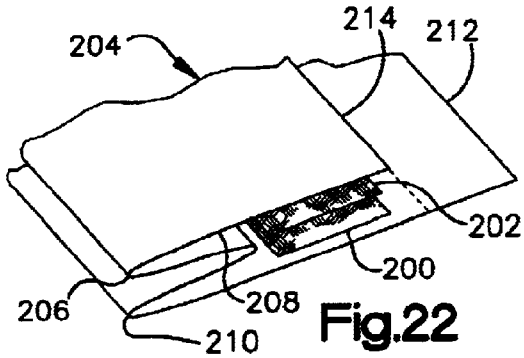
FIG. 22 is a perspective illustration of a web with three lengthwise folds to enable a single web to form two layers and an insert to form a gusset.

The sleeve 190 illustrated in FIG. 12 has a gusset 30 formed in its bottom. The inner layers 14, 16 may have a straight bottom edge 196. The gusset 30 may be formed in any convenient manner including that shown in U.S. Pat. No. 5,496,252, the entire disclosure of which is incorporated by reference and made a part hereof by its attachment as Appendix A. For example, the sleeve 190 including its gusset 30 may be manufactured using the arrangement of webs shown in FIG. 22. There are two fabric inner webs 200, 202 that will form the front and back inner layers 14, 16. The front and back outer layers 18, 20 are formed from a single web 204 folded along three fold lines 206, 208, 210 that extend parallel to the edges 212, 214 of the webs. The three folds form four layers 14, 20, the inner two layers 14, 16 becoming, in effect, an insert that forms the gusset 30 in FIG. 12. As an alternative, the inner layers 14, 16 may be formed of a single web folded in the same way that the web 204 is folded.

The top edge 220 of the inner layers 14, 16 are shown in FIG. 12 as being zigzag while the line 222 of perforations of the outer layers 18, 20 is straight across the sleeve 190. A gusset 30 like that in the sleeve 190 shown in FIG. 12 may also be included with any of the various arrangements described herein for the top edge(s) 220 of the inner layers 14, 16 and the top edges of the outer layers 18, 20.

Figure 13:
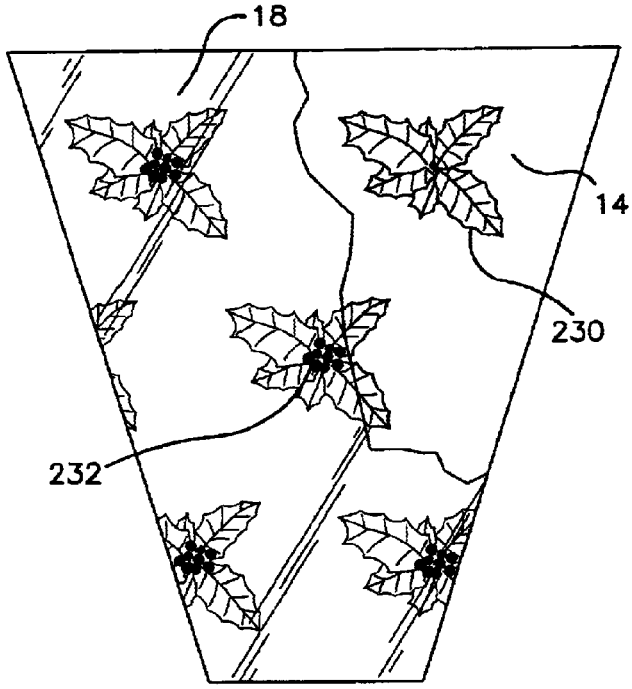
FIG. 13 is a sleeve using the present invention showing a first image on the outer layer, and the outer layer is partially cut away to show a complementary, second image on the inner layer.

As noted above any of a virtually unlimited variety of images may be used to enhance the appearance of the sleeves 190. FIG. 13 illustrates one such possibility, by way of example only and not by way of limitation. The front inner layer 14 shown in FIG. 13 is a non-woven polypropylene fabric and the outer layer 18 is a transparent cast polypropylene material. The inner layer 14 is printed with the pattern of holly leaves 230, generally dark green against a light green background. The outer layer 18 is printed with clusters of bright red holly berries 232 on an otherwise transparent sheet. When overlaid, the combined images show berry clusters growing out of the holly leaves. Of course this design is exemplary only, and many other designs taking advantage of the multiple layers are possible.

Figure 14:
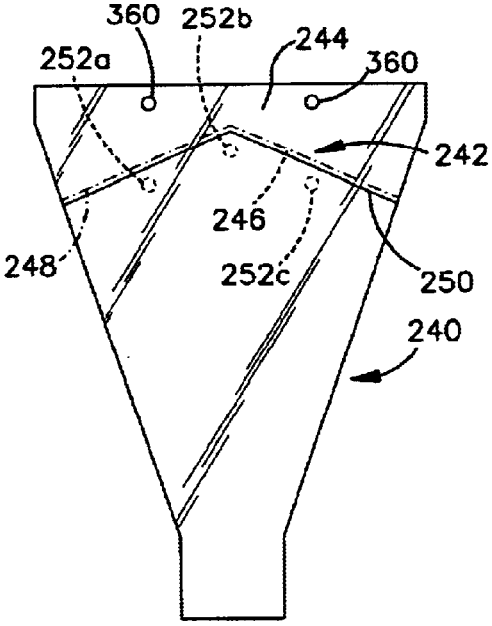
FIG. 14 is a sleeve using the present invention showing a Y-shape sleeve with patterned tear lines at the top to separate the sleeve from a header.

FIG. 14 shows another sleeve 240 made using the present invention. The sleeve 240 has a pointed top edge 242. The back layers 16, 20 extend up to a header 244. A line of perforations formed of two straight line segments 246, 248 separates the header 244 from the layers 16, 20 that form the back wall 42 of the sleeve 240. The layers 14, 18 forming the front wall 40 of the sleeve 240 are pre-cut as shown at 250 with the same peaked shape. In FIG. 14 the top front edge 250 is shown slightly displaced from the tear lines 246, 248. This is for illustrative purposes. However, the top front edge 250 and the lines of perforations 246, 248 could be intentionally made offset with either one being taller.

A means for fastening the front layers 14, 18 to each other and the back layers 16, 20 to each other is shown as drops 252*a–c* of glue or the like at three discrete locations. Any of the tabs shown in FIGS. 18–20 or the hot pin spot weld could also be used. Of course any of the fastening means described above could be used.

FIG. 15 illustrates yet another sleeve 260 made using the present invention. In this sleeve 260 the side edges 100, 102, rather than being formed each of a single or plural straight lines, are formed of curved lines. When opened to reveal the inner space, the sleeve 260 of FIG. 15 approximates the shape of the bell of a horn instrument such as a trumpet. A header 262 extends upward from the top of the back wall 42, separable from the back wall along a line of perforations 264. The perforations 264 are shown as forming two linear segments, but they could form a single straight line segment or a curved line, or a series of straight line segments.

In the sleeve 260 the top edge 266 of the front wall 40 is a straight line and located below the back wall's perforations 264. Further, the two layers 14, 18 of the front wall 40 both end at the edge 266. With this arrangement, a worker can easily open the sleeve to reveal its inner space, and therefore no adhesive or other securing means is necessary to hold layers 14, 18 together along the top edge 266.

Figure 23:
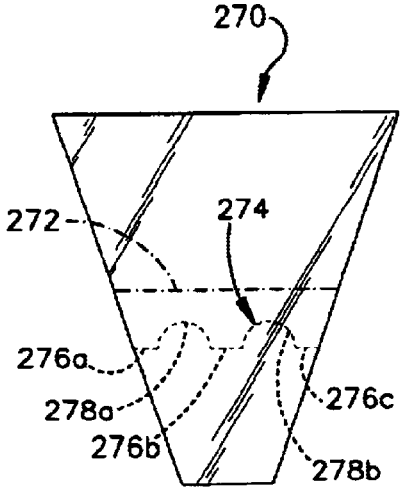
FIG. 23 illustrates another sleeve using the present invention having an inner layer with a top edge forming a series of curves.

FIG. 23 illustrates yet another sleeve 270 made following the teachings of the present invention. The sleeve 270 has a straight line of perforations 272 formed in the outer layers. The top edge 274 is shaped by a combination of straight segments 276*a, b* and *c* connected by curved segments 278*a* and *b*. These shapes are exemplary, and the curved segments 278 could have any curved shape, while there could be more or fewer straight segments 276.

It should be clear from the foregoing that sleeves 10, 60, 110, 130, 170, 180, 190, 240, 260, 270 constructed following the teachings of the present invention may have a variety of features in different combinations. The specific shape of the side walls may be varied, the height of the inner layer(s) may be varied, the shape of the top edge of the inner layers may be varied. The manner of securing the inner layers 14, 16 to the outer layers 18, 20 to facilitate opening the sleeve 260 also may be varied. The sleeves described are intended to be illustrative and not limiting, as other combinations will occur to those of ordinary skill in the art.

Figure 16:
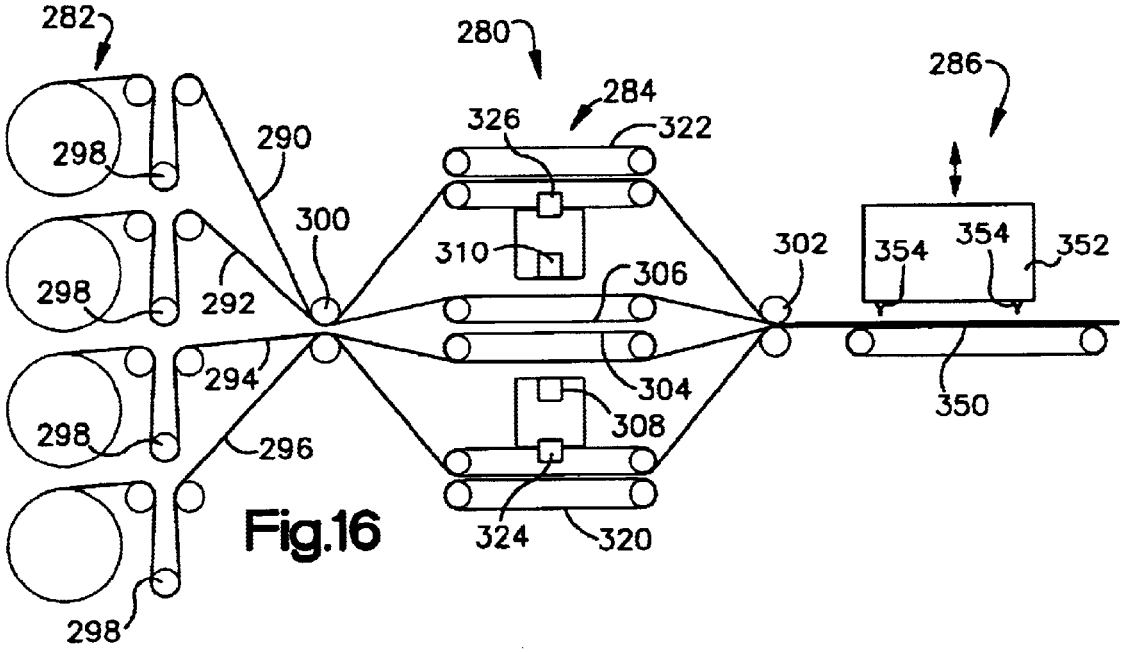
FIG. 16 is a schematic illustration of a machine for forming sleeves using the present invention.

FIG. 16 illustrates schematically a machine 280 and method for manufacturing sleeves following the teachings of the present invention. The machine 280 includes an infeed section 282, a synchronized section 284, and a sealing section 286.

The infeed section 282 includes supply webs 290, 292, 294 and 296. The illustration includes four webs, but more or fewer are possible. The webs 290–296 shown include a web 296 to form the back wall outer layer 20, a web 294 to form the back wall inner layer 16, a web 292 to form the front wall inner layer 14, and a web 290 to form the front wall outer layer 18. One of the outside webs, i.e., 290 or 296, includes regularly spaced printed registration marks or "eye spots" (not shown). A photosensor (not shown) is triggered by the passage of each eye spot, and the resulting signal is used to control the stepwise movement of the webs 290–296 through the machine 280. This equipment is conventional and needs no further description.

The webs 290, 292, 294 and 296 are fed through dancer rolls 298 which establish a desired tension in the webs before they go into the infeed nip rollers 300. This arrangement assures that all four webs 290–296 are moving together at the same speed and with the appropriate tension. The tension is adjusted so that the webs 290–296 can be processed properly in downstream stations and so that the images printed on them will be in correct registration. Moreover, proper tension helps the finished products to lie flat rather than buckling or puckering when the sleeves are cut from the webs 290–296 and the processing tension is released.

The webs 290–296 move from the infeed rollers 300 to the synchronized section 284. In the synchronized section 284, infeed nip rollers 300 and outlet nip rollers 302 advance the webs 290–296 stepwise. Specifically, the infeed and outlet nip rollers 300, 302 are actuated intermittently to advance the webs 290–296 stepwise throughout the machine 280 so that the sleeves 260 may be manufactured one or two at a time.

In the synchronized section 284 the webs 290–296 are separated and operations are performed separately on the inner webs 292, 294 and outer webs 290, 296 while the webs are stationary. After the operations on one sleeve 260 are completed, the webs 290–296 are advanced to bring the next sleeve into position.

In the synchronized section 284 the inner webs 292, 294 run against synchronized endless belts 304, 306. Reciprocating cutters, shown schematically at 308, 310, cut the top and/or bottom edges of the inner webs 292, 294 to the desired shape. For example, the zigzag top edge 132 shown in FIG. 7 may be formed in this section. Scrap material is also removed at this point.

The webs 290, 296 which form in the outer layers 18, 20 may run against similar endless belts 320, 322, and various cutters 324, 326 may be used to form the perforations. Where the perforations form a continuous straight line parallel to the direction of the movement of the web 290–296, the perforations may be formed by a fixed rotary device which is well known in the art. If the perforations form a series of straight lines in a zigzag pattern or a curved pattern, then a reciprocating cutter may be used. Such a cutter carries a hot rule die or hot wire of the appropriate shape and presses the webs 290, 296 against the belts 320, 322 or other appropriate cutting surface to perforate the webs when they are momentarily stationary in the synchronized section 284.

After being cut and/or perforated, the webs 290–296 are rejoined by the outlet nip rollers 302. These rollers 302 are driven intermittently so that the webs 290, 292, 294 and 296 advance stepwise through the machine 280.

Figure 17:
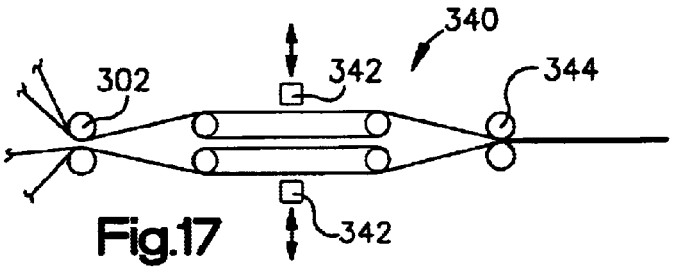
FIG. 17 is a schematic illustration of an alternative component which may be used in connection with the machine shown in FIG. 16.
Figure 18:
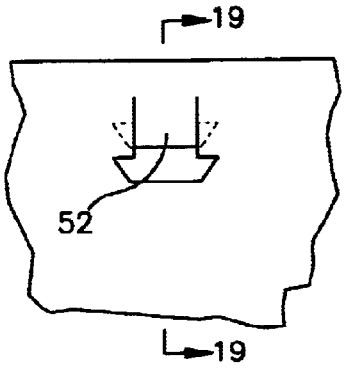
FIG. 18 is a front elevation view of a barb used to hold together layers of a sleeve using the present invention.
Figure 19:
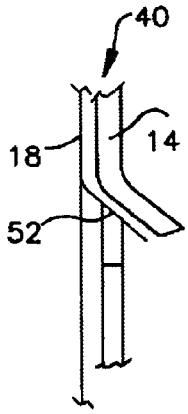
FIG. 19 is a cross section view looking in the direction of arrows 19—19 of FIG. 18.
Figure 20:
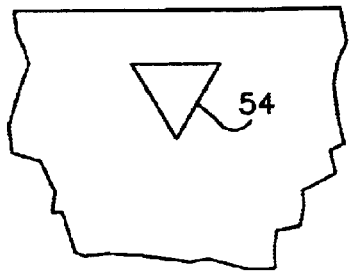
FIG. 20 is a front elevation of another barb that may be used to hold together the layers of a sleeve using the present invention.
Figure 21:
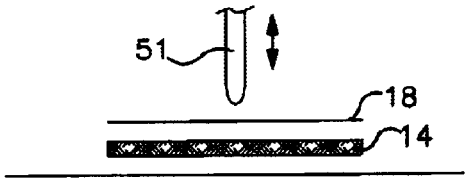
FIG. 21 is a schematic illustration of a hot pin used to fasten a cast sheet layer to a fabric layer of a sleeve using the present invention.

The synchronization section 284 may also include a device for effecting the connection between the front layers 14, 18 and another device for effecting the connection between the rear layers 16, 20. As noted above this may be the simple spot of glue 50, and the connection making device may be simply an adhesive applier mounted to move with the cutters 308 and 310 or 324 and 326. If perforations of one sort are or another are used to secure the webs 290, 292 forming the front wall 40 to each other and the layers 294, 296 forming the back wall 42 to each other (such as shown in FIGS. 18–20), then an additional section 340 as shown in FIG. 17 may be used. This section 340 may be located between the outlet nip rollers 302 and the cutting section 286. In this additional section 340 the front two webs 290, 292 and the two rear webs 294, 296 each run together. Appropriate dies 342 punch one or both of the two webs 290, 292 and/or 294, 296, join them with hot needles or apply ultrasonic or laser energy or other radiant energy to connect the layers 14, 20 at the desired discrete locations. The section 340 ends with a pair of nip rollers 344.

Thereafter the webs 290–296 advance to the sealing section 286 where cuts that form the side edges 26, 28 are made. In the cutting section 286 the four webs 290–296 run together against a synchronized endless, heat resistant, and anti-static belt 350. The cutting section 286 includes a reciprocating cutter head 352. This cutter head 352 includes hot knives or rule dies 354 that cut and seal the lateral edges. The hot knives or dies 354 may be of any desired shape including the straight lines which form trapezoidal sleeves 10 as shown in FIGS. 1–3. Alternatively the hot knives may have a single bend in each side to form the Y-shaped sleeves 70 as shown in FIG. 4, or two bends to form the sleeve 40 shown in FIG. 5. Alternatively the curved wall shape shown in FIG. 15 can be formed with continuously curved dies. Any other desired shape is possible. After passing through the cutting section 286, the sleeves 260, now separated from one another, may be stacked on pins on an outlet conveyor. When the desired count in each stack is achieved, holes 360 (FIGS. 12, 14, 15) may be formed by conventional means that punch holes and simultaneously melt the plastic around the holes to unite the headers 192 of each stack.

The sealing process using the present invention joins a fabric inner layer with a compatible outer layer. As the heated rule die 354 (FIG. 16) or other cutter presses the layers together, heat is transferred first predominantly to the cast sheet outer layers 290, 296 because they have the largest mass and area in contact with the cutter 354. A molten bead forms at the newly formed edge of the cast sheet tracing the edge of the cutter. The fibers of the fabric webs 292, 294 also absorb heat. These fibers form molten drops at their ends which quickly merge with the bead at the edge of the outer layers 290, 296. This fuses the fibers with the fabric layers 292, 294, holding the fabric layers in place and keeping them from pulling away from the cutter dies 354 which if allowed to occur could weaken their connection at the seam.

The fusing phenomenon is perhaps explained by the relative ratios of surface area to mass of the fabric inner layers 292, 294 and the cast sheet outer layers 290, 296. The cast sheet layers 290, 296 have more mass per unit of surface area, and therefore they can absorb a relatively larger amount of heat than the fabric webs 292, 294. The fabric webs 292, 294 are made of fibers, typically about 1.5 Dernier ±0.3 Dernier. When one of these fibers contacts the die, the die quickly cuts through it and a molten drop forms at the fiber's end. As more heat is transferred to the fiber, more of it becomes molten and the molten drop, as it grows in volume, retreats from the hot die, pulled away by the surface tension of the drop. In a fabric, this process is repeated with each fiber, with the drops merging but retreating from the heat source. As a consequence, seals made with a hot knife between two layers each of non-woven fabric have proven not to be strong enough or reliable.

The presence of the cast sheet layer(s) 290, 292 with more mass form a bead of molten material limits the retreat of the drops on the fabric fibers. It is believed this occurs because the cast sheet, having more mass, can more easily absorb the heat transferred from the die and because the pressure of the cutter 354 forces the molten fabric drops to merge with cast sheet bead and so holds the fabric in place.

The present invention then may be practiced in a variety of ways. The cast webs 290, 296 may be inside the fabric webs 292, 294. The cast webs 290, 292 may be only a narrow strip between the two fabric layers, so long as such a denser layer or layers is present with the fabric layer(s) to absorb and control the heat flux from the cutter 354 so that the fabric and sheet webs may melt and merge securely.

It should be noted that the various sections 284, 296, 340 and the operations performed in each section may be rearranged or performed in any order. Generally it is preferred to place the sealing or cutting section 286 last (and just before the stacking station) so that all the preceding operations may be performed on webs of material, webs being generally easier to handle than separate pieces of sheet material or individual sleeves. For example, the operation of punching holes 360 through the header 192 could be performed in the synchronization section 284, or in a separate section between the sealing section 286 and the synchronization section 284. Other rearrangements of the components will be apparent to those of ordinary skill in the art.

Thus it is clear that the present invention may be used to provide a sleeve 10, 70, 40, 110, 130, 170, 180, 190, 240, 260 or 270 with multiple layers 14–20 that provide new graphic design possibilities by having the inner layers 14, 16 at least partially visible through the outer layers 18, 20. Complimentary images may be formed on the inner and outer layers 14, 16 and 18, 20. Moreover, the inner layer(s) 14, 16 may have any desired top edge profile, and that top edge may be above or below the top edge of the outer layer 18, 20. The inner and outer layers of the front wall 40 and the inner and outer layers 16, 20 of the back walls 42 may be connected to each other by glue 50 or various mechanical means to facilitate separating the layers 14–20 when the sleeve 10, 70, 40, 110, 130, 170, 180, 190, 240, 260 is opened to reveal the space where a bouquet pot plant or the like may be placed.

What is claimed is:

1. A sleeve for an article, the sleeve having front and back walls with opposite side edges connected to each other, one of the front and back walls including two layers, an outer layer of a first material, and an inner layer the outer layer being joined to the inner layer at a discrete location near a top edge of one of the inner and outer layers and along the sides edges of a second material, the inner layer being at least partially visible through the outer layer, the layers of the at least one wall being formed of materials having substantially the same melting point and substantially the same melt index.

2. The sleeve of claim 1 wherein the two layers have complementary images thereon.

3. The sleeve of claim 1 wherein the first material is a cast polyolefin and the second material is a polyolefin fabric.

4. The sleeve of claim 1 wherein the two layers are each cut from a web of the respective first and second materials and joined to each other in a single operation.

5. The sleeve of claim 1 wherein the front wall and back wall have top edges that may be separated to reveal a space between the front and back walls into which the bouquet, potted plant or the like may be placed to be at least partially surrounded by the sleeve, and the inner and outer layers of the one of the front and back walls include a connection to each other near the top edges of the walls to facilitate separation of the front and back walls.

6. The sleeve of claim 1 wherein the front wall and back wall have top edges that may be separated to form an opening into which the article may be placed, and the inner and outer layers of the one wall include means for facilitating separating the one wall from the other of the front and back walls.

7. The sleeve of claim 6 wherein the means for facilitating includes a spot of adhesive near the top edges between the inner and outer layers.

8. The sleeve of claim 6 wherein the means for facilitating includes a thermal weld between the inner and outer layers.

9. The sleeve of claim 8 wherein the thermal weld is formed by a hot needle that penetrates the layers of the one wall to form a local spot weld.

10. The sleeve of claim 6 wherein the means for facilitating includes a weld formed by the local application of energy.

11. The sleeve of claim 6 wherein the means for facilitating includes a cut out in one of the front wall and back wall that exposes a portion of the other of the front wall and back wall for gripping.

12. The sleeve of claim 1 wherein the front wall and back wall have top edges that may be separated to reveal a space between the front and back walls into which the article may be placed to be at least partially surrounded by the sleeve, and one of the layers of the one wall has a top edge which defines the top edge of the one wall and the other layer of the one wall has a top edge spaced from the top edge of the one layer.

13. The sleeve of claim 12 wherein the top edge of the other layer is below the top edge of the one layer.

14. The sleeve of claim 12 wherein the top edge of the other layer is formed in a substantially straight line.

15. The sleeve of claim 12 wherein the top edge of the other layer is formed of a series of substantially straight lines connected to each other.

16. The sleeve of claim 1 wherein the front wall and back wall have top edges that may be separated to reveal a space between the front and back walls into which the article potted plant or the like may be placed to be at least partially surrounded by the sleeve, and the front and back walls further include a sequence of perforations extending between the side edges of the sleeve for separating an upper portion of the sleeve from a lower portion of the sleeve.

17. The sleeve of claim 16 wherein one of the layers of the one wall has a top edge which defines the top edge of the one wall and the other layer of the one wall has a top edge spaced from the top edge of the one layer.

18. The sleeve of claim 17 wherein the sequence of perforations is near to the top edge of the other layer.

19. The sleeve of claim 18 wherein the sequence of perforations defines a single generally straight line.

20. The sleeve of claim 18 wherein the sequence of perforations defines a series of line segments joined one to another.

21. The sleeve of claim 18 wherein the front wall and back wall have bottom edges that extend between the side edges, the bottom edges being joined to each other to form a closed bottom.

22. The sleeve of claim 21 wherein the bottom edges each form a straight line.

23. The sleeve of claim 21 wherein the bottom edges each form a sequence of straight lines.

24. The sleeve of claim 18 wherein the front wall and back wall have bottom edges that extend between the side edges, the bottom edges each form a sequence of three straight lines, and the sleeve includes an insert connected to the bottom edges to form a gusset.

25. The sleeve of claim 1 wherein the front wall and back wall have bottom edges that extend between the side edges, the bottom edges being joined to each other to form a closed bottom.

26. The sleeve of claim 25 wherein the bottom edges each form a straight line.

27. The sleeve of claim 25 wherein the bottom edges each form a sequence of straight lines.

28. The sleeve of claim 25 wherein the front wall and back wall have bottom edges that extend between the side edges, the bottom edges each from a sequence of three straight lines, and the sleeve includes an insert connected to the bottom edges to form a gusset.

29. The sleeve of claim 1 wherein the side edges define straight lines and taper toward each other.

30. The sleeve of claim 1 wherein the side edges each define two straight lines.

31. The sleeve of claim 1 wherein the side edges are curved.

32. A A sleeve for an article, the sleeve having front and back walls with opposite side edges connected to each other, one of the front and back walls including two layers, the inner layer being at least partially visible through the outer layer, the front wall and back walls having top edges that may be separated to reveal a space between the front and back walls into which the article may be placed to be at least partially surrounded by the sleeve, and one of the layers of the one wall has a top edge which defines the top edge of the one wall and the other layer the outer layer being joined to the inner layer at a discrete location near a top edge of one of the inner and outer layers and along the side edges of the one wall has a top edge spaced from the top edge of the one layer.

33. The sleeve of claim 32 wherein the top edge of the other layer is below the top edge of the one layer.

34. The sleeve of claim 32 wherein the top edge of the other layer is formed in a substantially straight line.

35. The sleeve of claim 32 wherein the top edge of the other layer is formed of a series of substantially straight lines connected to each other.

36. The sleeve of claim 32 wherein the front wall and back wall have top edges that may be separated to reveal a space between the front and back walls into which the article may be placed to be at least partially surrounded by the sleeve, and the front and back walls further include a sequence of perforations extending between the side edges of the sleeve for separating an upper portion of the sleeve from a lower portion of the sleeve.

37. A method of packaging the article comprising the steps of providing a sleeve having a front wall and a back wall, the front and back walls being joined to each other along side edges and having top and bottom edges, a length of the top edges of the walls being free of connection to each other so that the top edges of the walls may be separated to open the sleeve, at least one of the front and back walls having an inner layer and an outer layer separable from the inner layer, the outer layer being joined to the inner layer at a discrete location near a top edge of one of the inner and outer layers and a long the side edges, separating the front wall from the back wall to reveal an inner retaining space by moving the outer layer of the one wall away from the other wall, and placing the article in the inner retaining space so revealed.

38. The method of claim 37 wherein the step of providing a sleeve includes the step of providing a sleeve formed of polyolefin sheet material, and in which the front wall and back wall are joined by heat sealing the side edges.

39. The method of claim 37 wherein the step of providing a sleeve that includes at least one of the front and back walls having an inner layer and an outer layer joined at a discrete location to the inner layer includes providing a sleeve wherein the inner and outer layers of the one wall are joined by pressing a tab of one layer through the other layer.

40. The method of claim 37 wherein the step of providing a sleeve that includes at least one of the front and back walls having an inner layer and an outer layer joined to the inner layer at a discrete location includes providing a sleeve wherein the inner and outer layers of the one wall are joined by applying an adhesive at a discrete location to one of the layers.

41. The method of claim 37 wherein the step of providing a sleeve that includes at least one of the front and back walls having an inner layer and an outer layer joined to the inner layer at a discrete location includes providing a sleeve wherein the inner and outer layers of the one wall are joined by pressing a hot pin through the layers to melt the two layers to each other at a discrete location.

42. The method of claim 37 wherein the step of providing a sleeve that includes at least one of the front and back walls having an inner layer and an outer layer joined to the inner layer at a discrete location includes providing a sleeve wherein the inner and outer layers of the one wall are joined by applying radiant energy.

43. The method of claim 37 wherein the step of providing a sleeve that includes at least one of the front and back walls having an inner layer and an outer layer includes providing an inner layer with a top edge that defines a single substantially straight line.

44. The method of claim 37 wherein the step of providing a sleeve that includes at least one of the front and back walls having an inner layer and an outer layer included providing an inner layer with a top edge that defines a series of substantially straight lines.

45. The method of claim 37 wherein the step of providing a sleeve that includes at least one of the front and back walls having an inner layer and an outer layer includes providing an inner layer with a top edge that defines two straight lines.

46. The method of claim 37 wherein the step of providing a sleeve that includes at least one of the front and back walls having an inner layer and an outer layer includes providing an inner layer with a top edge that defines a series of curved lines.

47. The method of claim 46 wherein the step of providing a sleeve with perforations includes providing a sleeve with perforations that form a series of straight lines.

48. The method of claim 46 wherein the step of providing a sleeve with perforations includes providing a sleeve with perforations that form a series of curved lines.

49. The method of claim 37 wherein the step of providing a sleeve includes the step of providing a sleeve with perforations extending between the side edges, and further including the step of separating a part of one layer of the wall with at least two layers from the sleeve along the perforations.

50. The method of claim 49 wherein the step of providing a sleeve with perforations includes providing a sleeve with perforations that form a single straight line.

51. The method of claim 49 wherein the step of providing a sleeve that includes at least one of the front and back walls having an inner layer and an outer layer joined to the inner layer, at a discrete location near a top edge of one of the layers includes providing a sleeve wherein the inner and outer layers of the one wall are joined by pressing a tab of one layer through the other layer.

52. The method of claim 49 wherein the step of providing a sleeve that includes at least one of the front and back walls having an inner layer and an outer layer joined to the inner layer, the inner and outer layers of the one of the front and back walls being joined to each other at at least one discrete location near a top edge of one of the layers includes providing a sleeve wherein the inner and outer layers of the one wall are joined by applying an adhesive to one of the layers.

53. The method of claim 49 wherein the step of providing a sleeve that includes at least one of the front and back walls having an inner layer and an outer layer joined to the inner layer, the inner and outer layers of the one of the front and back walls being joined to each other at at least one discrete location near a top edge of one of the layers includes providing a sleeve wherein the inner and outer layers of the one wall are joined by pressing a hot pin through the layers to melt the two layers to each other at a discrete location.

54. The method of claim 49 wherein the step of providing a sleeve that includes at least one of the front and back walls having an inner layer and an outer layer joined to the inner layer, the inner and outer layers of the one of the front and back walls being joined to each other at at least one discrete location near a top edge of one of the layers includes providing a sleeve wherein the inner and outer layers of the one wall are joined by applying radiant energy.

55. The method of claim 49 wherein the step of providing a sleeve that includes at least one of the front and back walls having an inner layer and an outer layer joined to the inner layer includes providing an inner layer with a top edge that defines a single substantially straight line.

56. The method of claim 49 wherein the step of providing a sleeve that includes at least one of the front and back walls having an inner layer and an outer layer joined to the inner layer includes providing an inner layer with a top edge that defines a series of substantially straight lines.

57. The method of claim 49 wherein the step of providing a sleeve that includes at least one of the front and back walls having an inner layer and an outer layer joined to the inner layer includes providing an inner layer with a top edge that defines two straight lines.

58. The method of claim 49 wherein the step of providing a sleeve that includes at least one of the front and back walls having an inner layer and an outer layer joined to the inner layer includes providing an inner layer with a top edge that defines a series of curved lines.

* * * * *